United States Patent [19]

Aumann et al.

[11] 4,272,987

[45] Jun. 16, 1981

[54] PRESSURE CORE BARREL FLUSHING SYSTEM

[75] Inventors: James T. Aumann, Salt Lake City; Harold G. White, West Jordan, both of Utah

[73] Assignee: Christensen, Inc., Salt Lake City, Utah

[21] Appl. No.: 99,670

[22] Filed: Dec. 3, 1979

[51] Int. Cl.[3] ..... E21B 47/00

[52] U.S. Cl. ..... 73/153

[58] Field of Search ..... 23/230 EP; 175/226, 175/232, 233, 234, 239, 241, 242, 58, 59, 17; 73/153, 155

[56] References Cited

U.S. PATENT DOCUMENTS

| | | | |
|---|---|---|---|
| 2,238,609 | 4/1941 | Sewell . | |
| 2,287,909 | 6/1942 | Sewell | 175/233 |
| 2,381,845 | 8/1945 | Stokes | 175/233 |
| 2,412,915 | 12/1946 | Sewell | 175/233 |
| 2,445,494 | 7/1948 | Redmond . | |
| 2,734,719 | 2/1956 | Otway | 175/233 |
| 3,548,958 | 12/1970 | Blackwell et al. | 175/233 |

*Primary Examiner*—Jerry W. Myracle
*Attorney, Agent, or Firm*—Walter Fred

[57] ABSTRACT

This invention relates to improvements in pressure core barrels of the type described in U.S. Pat. No. 3,548,958 wherein a controlled pressure is maintained on a core sample during surfacing. Among the improvements provided by the present invention are an improved arrangement of the pressure control valve, a device for positively latching the assembly (both in the open and closed positions) and the provision of a hydraulic assist for moving the outer barrel to the sealing position. Another particular feature provides an improved device for flushing drilling mud from the core barrel mechanism with sealing valve open and while the core sample is maintained substantially at a pressure at which it was sealed in the bore hole and to facilitate subsequent freezing and removal of the core sample therefrom for analysis.

11 Claims, 12 Drawing Figures

FIG 1.A

PRESSURE CORE BARREL FLUSHING SYSTEM

TECHNICAL FIELD

This invention relates to the recovery of core barrel samples from the bottom of an oil well where it is desired to seal the core barrel sample and maintain it under the pressure existing at the bottom of the well when the sample is brought to the surface of the well.

Particularly, the invention relates to improved means for flushing drilling mud and cuttings from pressure core barrel mechanisms prior to freezing of the core and its subsequent removal for analysis.

The invention also provides for positive indication at the well surface that the outer barrel is locked in sealing position and that the valve at the bottom of the core barrel is closed.

BACKGROUND OF THE INVENTION AND PRIOR ART

The present invention relates to a pressure core barrel assembly for recovering a core at formation pressure and is specifically directed to improvements in the type of pressure core barrel described in U.S. Pat. No. 3,548,958 issued 12/27/70 to Blackwell and Rumble. In such a pressure core barrel assembly it is important to know that the pressure core barrel has been sealed at formation pressure before the barrel is raised to the surface. If it is not sealed the sample will not be representative of the actual conditions existing in the formation at the bottom of the well.

Present practice requires that the core be frozen under pressure to trap the fluids in the core so that removing the pressure will not alter fluid content of the core.

In order to be able to disassemble the barrel and remove the frozen core for analysis, the drilling mud, containing fluid and cuttings, in the barrel must be displaced with a fluid such as gelled kerosene which will not freeze at dry ice temperatures.

Prior art core barrels including the one disclosed in U.S. Pat. No. 3,548,958 are equipped with internal ports and valves so that this displacement or flushing can be done while pressure is maintained on the core. These internal valves are a frequent cause of leakage and loss of pressure. Additionally, because of space limitations the internal ports are small and frequently clog with drilling mud or cuttings during flushing. This results in only partial flushing and subsequent freezing of the mud between the inner and outer barrel and around the ball valve assembly. The ball valve must also remain closed during flushing and freezing. The ball valve and operator are frequently frozen to the core barrel because of insufficient flushing in this area of the tool. This often results in damage to the ball valve operator and gears when the ball valve is opened after freezing to remove the core.

SUMMARY OF THE INVENTION

The present invention provides an improved pressure core barrel of the type generally described in the above Blackwell et al U.S. Pat. No. 3,548,958 which has a number of improved features. First, the outer barrel (containing within it the core barrel) which is to seal the assembly at formation pressure is positively latched in both the raised (coring) position and the lowered (sealing) position. The arrangement of parts also provides for positive hydraulic assist for moving the outer barrel downwardly during the sealing operation to overcome any friction present at the bottom of the well. This is accomplished by using full mud hydraulic pressure both for triggering the latching mechanism and also for driving the outer barrel downward. Additionally, this hydraulic pressure is not released until the outer barrel has traveled substantially completely to the bottom position. Another feature of the invention provides that the pressurizing gas valve is not opened until the outer barrel has been lowered essentially to the closed position and the core sealing valve is being operated. Another feature provides for spring loaded actuation of the core sealing valve to prevent damage to the valve actuating mechanism in the event of jamming thereof. Another feature of the invention provides for the use of heavy duty splines and locking dogs which permit locking in both the open and closed position and also the transmission of torque in both open and closed positions. Other detailed advantages and improvements in the present invention will be apparent from the following discussion.

This invention also provides an improved apparatus and method for flushing the improved pressure core barrel prior to freezing. The barrel is externally sealed by installing inlet flushing means on one end and outlet flushing means on its other end. The outlet means is then pressurized and checked for leaks. The core sealing ball valve is then rotated to the open position and the internal pressure read with a pressure gage in the outlet flushing means. The inlet means is then pressurized and checked for leaks. Flushing begins by pumping gelled Varsol (Reg. TM of Exxon) or kerosene through the inlet flushing means which will in turn open movable seal means and displace mud from the barrel through the outlet means adapted to maintain pressure of formation inside the core barrel.

Thereafter, the inlet and outlet flushing means are closed to cut off flushing and maintain pressure in the core barrel, the barrel packed in dry ice and the core frozen with the sealing means in open positions. Following freezing, the outlet means are opened, to bleed off pressure and then removed. The inner core tube with the frozen core sample can then be easily removed through the open ball valve for analysis.

DETAILED DESCRIPTION OF THE INVENTION

In order to understand the details of the invention reference should be had to the following drawings which describe the preferred non-limiting example of the invention. In these figures (where possible) reference numerals have been used which are the same as those used in the equivalent elements of Blackwell et al U.S. Pat. No. 3,548,958. In these drawing FIG. 1 is a schematic diagramatic partially sectional view of the top part of the pressure core barrel assembly in the coring position.

Figure 1:
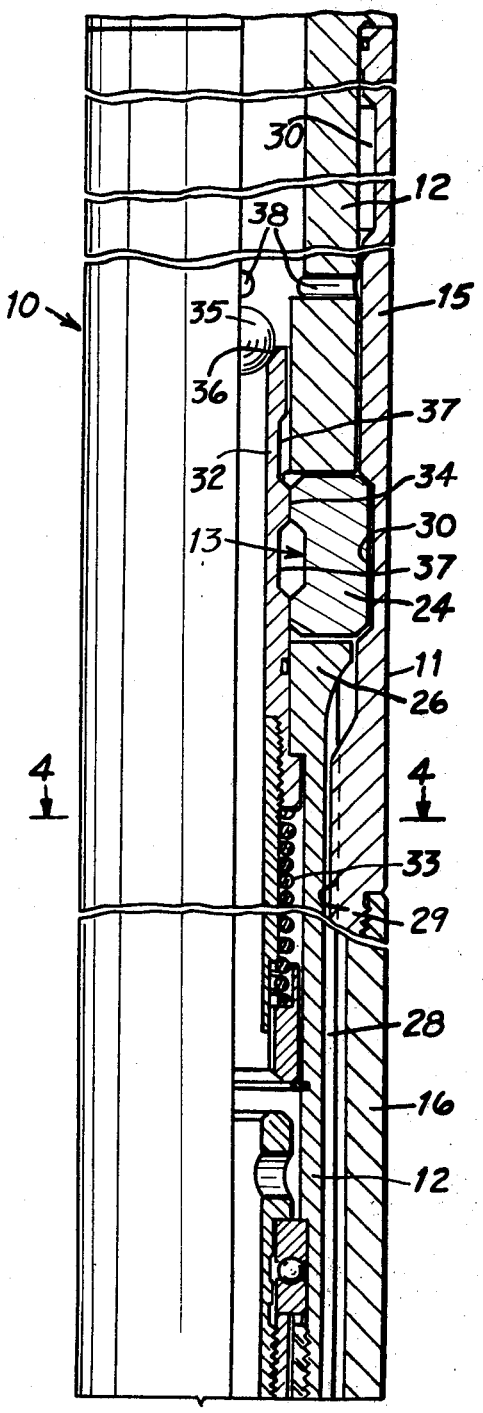
FIG. 1A shows the next lower section of the core barrel assembly where the pressurizing gas source and its valves are located, the assembly being in the coring position.
FIG. 1B illustrates the next lower section of the core barrel assembly showing the details of the gas pressurizing valve and the spring mechanism for protecting the core sealing valve, FIG. 1B being in the open coring position.
FIG. 1C shows the details of the bottom of the core barrel assembly in the open position and FIG. 2C shows the same portion of the core assembly in the sealed position.
Figure 2:
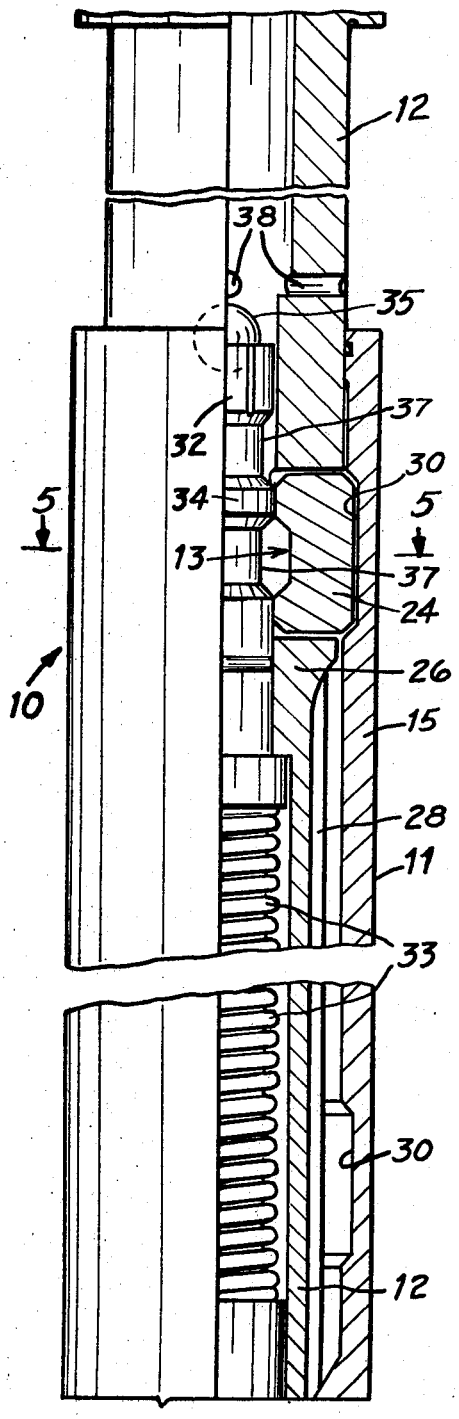
FIG. 2 is similar to FIG. 1 with the core barrel assembly in the sealed position.
Figure 3:
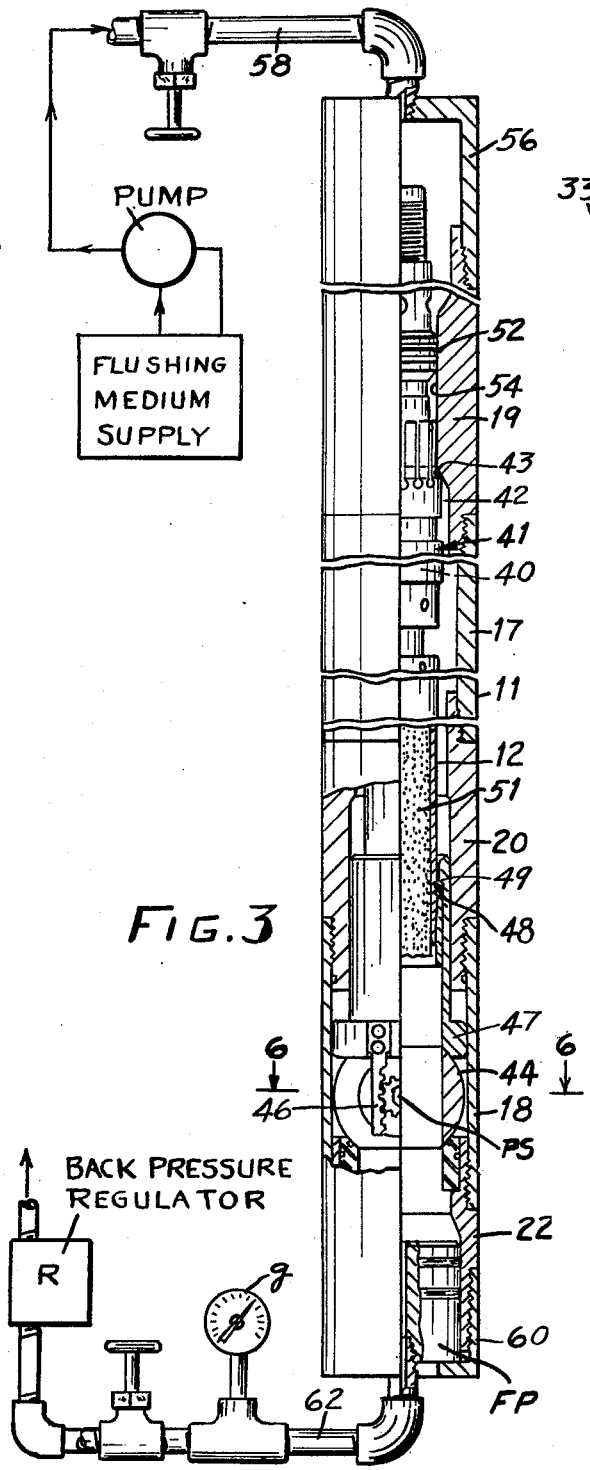
FIG. 3 shows the sealed core barrel assembly mounted in a pressurized flushing systems for flushing drilling mud from the core barrel assembly prior to the freezing of the assembly for sectioning and analysis.

Referring now to the details shown in FIGS. 1 through 3 the construction of the core barrel assembly 10 includes an outer barrel 11 and an inner barrel 12 interconnected by a slip joint assembly generally indicated at 13. The outer barrel assembly 11 is made up of a number of sections indicated at 15, 16, 17 and 18 with several connecting subs 19 and 20. The bottom of the outer barrel assembly is provided with a sub 22 adapted to be connected to the core bit (not shown). Inner core barrel 12 is arranged to be supported by the drill string by means of a connection at the top thereof (not shown).

Referring now to the specific detail of construction as shown in FIGS. 1 and 2 it can be seen that the outer core barrel 11 is held in the upper (open) position by means of three dogs 24 carried by an enlarged splined upper section 26 of the inner core barrel support mechanism 12.

Figure 4:
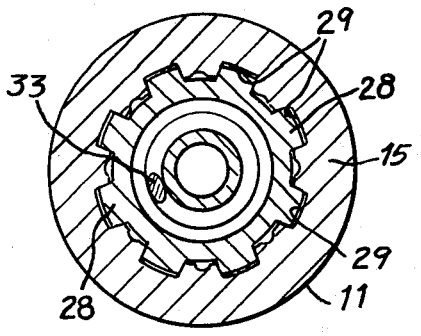
FIG. 4 is a sectional view taken along the line 4—4 of FIG. 1.
Figure 5:
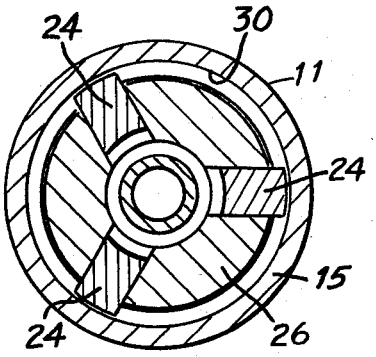
FIG. 5 is a sectional view taken along the line 5—5 of FIG. 2.

In FIG. 4 there is shown the spline 28 which engages female splines 29 on the outer barrel assembly. Details of the dogs 24 and their operative grooves 30 are shown in FIG. 5. As can be seen, there are three dogs which operate in the groove 30 and, in a preferred embodiment, there are eight splines. Accordingly rotation of the splines by one-eighth of a turn on each reassembly of the core barrel assembly provides for rotation of the dogs 24 to engage a different portion of the cylindrical groove 30, thus equalizing wear in these grooves.

Supported on the inner assembly is a latch actuting cylinder 32 which is held in the upper position (as shown) by spring 33. In this position the full diameter portion 34 of the cylinder 32 bears on the back surfaces of the latch dogs 24 and holds the latch dogs fully extended into the cylindrical groove 30. In FIG. 1 the latch dogs 24 are shown in the lower cylindrical groove 30 and in FIG. 2 they are shown engaged in the upper cylindrical groove 30.

FIG. 1 also shows ball 35 which has been pumped down into a valve seat 36 at the top of the hollow latch actuating cylinder 32. In normal operation, without the ball 35, the drilling mud passes down the axis of the core barrel through the hollow cylinder and down to the bottom of the core bit in accordance with standard coring practice. When the ball 35 is seated in the valve seat 36 the flow of drilling mud is interrupted and the pressure above the ball 35 increases tending to force the latch actuating cylinder 32 down. When the full diameter portions 34 of the latch actuating cylinder 32 have moved downwardly a sufficient amount to free the latch dogs for inward motion, these latch dogs are forced into cylindrical grooves 37 carried by the cylinder 32. This releases the outer barrel and permits it to travel from the open position to the closed position shown in FIG. 2. As the latch actuating cylinder 32 is forced downwardly by the hydraulic pressure bearing on the ball 35 it compresses the spring 33 as long as the full hydraulic pressure remains above the ball 35. As the outer barrel 11 moves downwardly the upper end thereof passes opening 38 which allows the full mud pressure to be vented to the exterior of the core barrel assembly. This releases the pressure above the ball 35 allowing the spring 33 to move the latch actuating cylinder 32 to the upward position thus forcing latch dogs 24 back outwardly when the upper cylindrical groove 30 reaches these dogs.

Referring to FIGS. 1A, 1B, 2A and 2B there are shown details of the pressure control system and its operating valve. This system in many respects is similar to the pressure control system as described in U.S. Pat. No. 3,548,958. There is similar pressurized nitrogen reservoir 40, a pressure regulator 41, a cut-off valve 42, and a valve actuator 43. In function these elements are essentially the same as the corresponding elements in Blackwell et al. In the present invention, however, the valve actuator is a shoulder 43 carried by the outer barrel assembly and is arranged to move the cut-off valve 42 downwardly when the outer barrel has reached its lower position. This permits pressurization of the core barrel assembly only after the core barrel assembly is approaching its sealed condition.

Figure 2A:
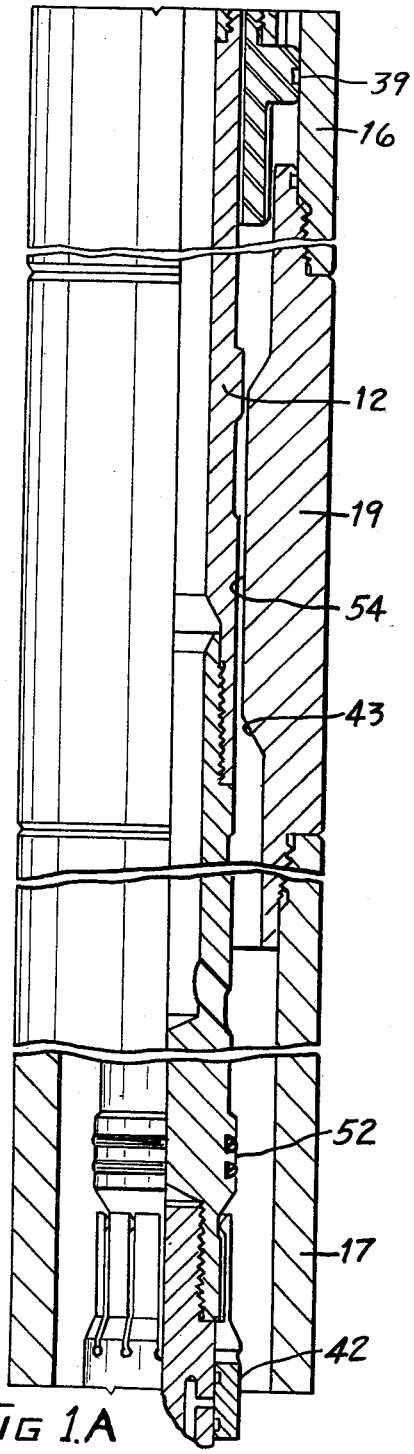
FIG. 2A is like FIG. 1A with the gas pressurizing valve assembly open and the core in the sealed condition.
Figure 2A:
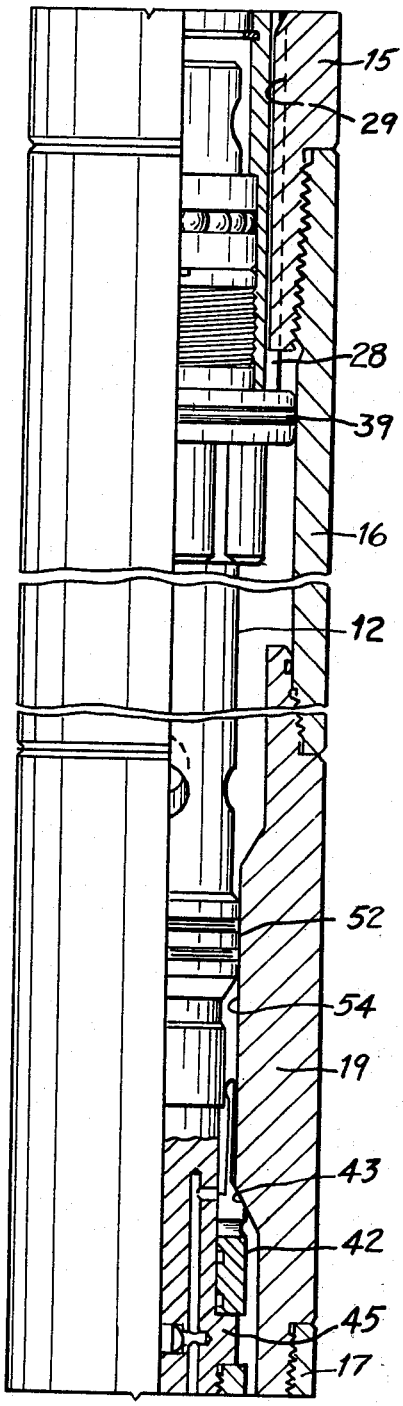
Figure 1B:
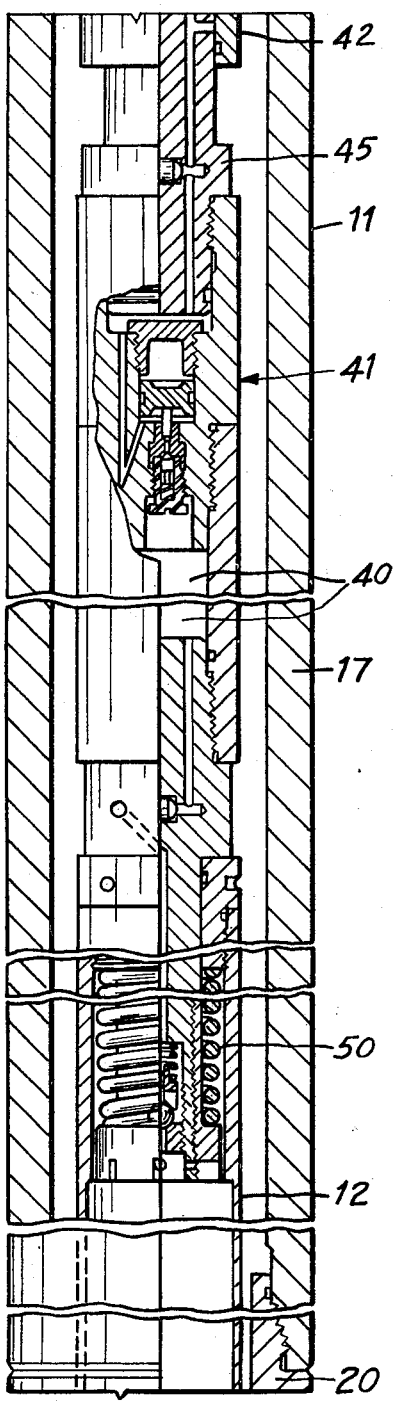
Figure 2B:
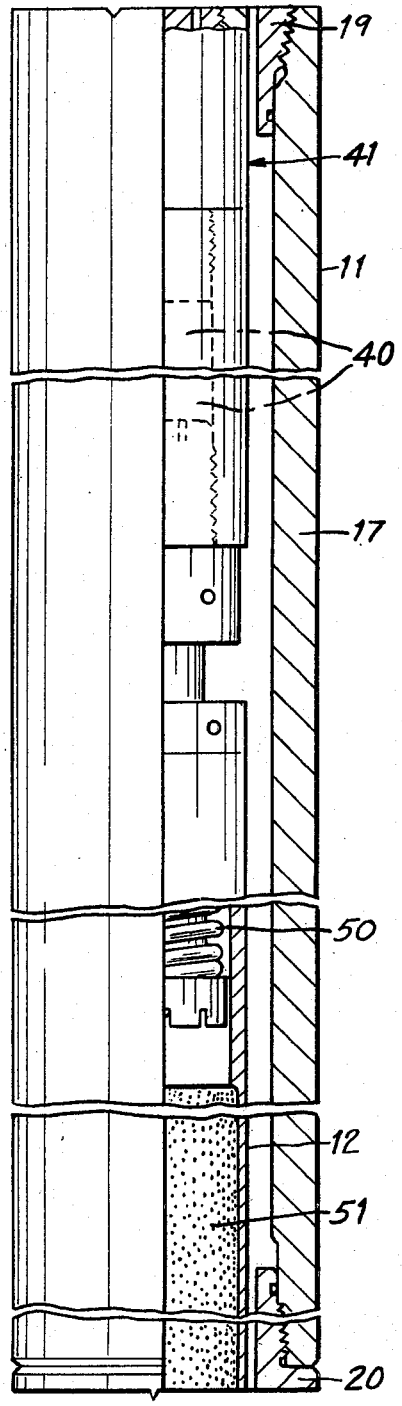
FIG. 2B is similar to FIG. 1B with the elements in the closed sealing position.
Figure 1C:
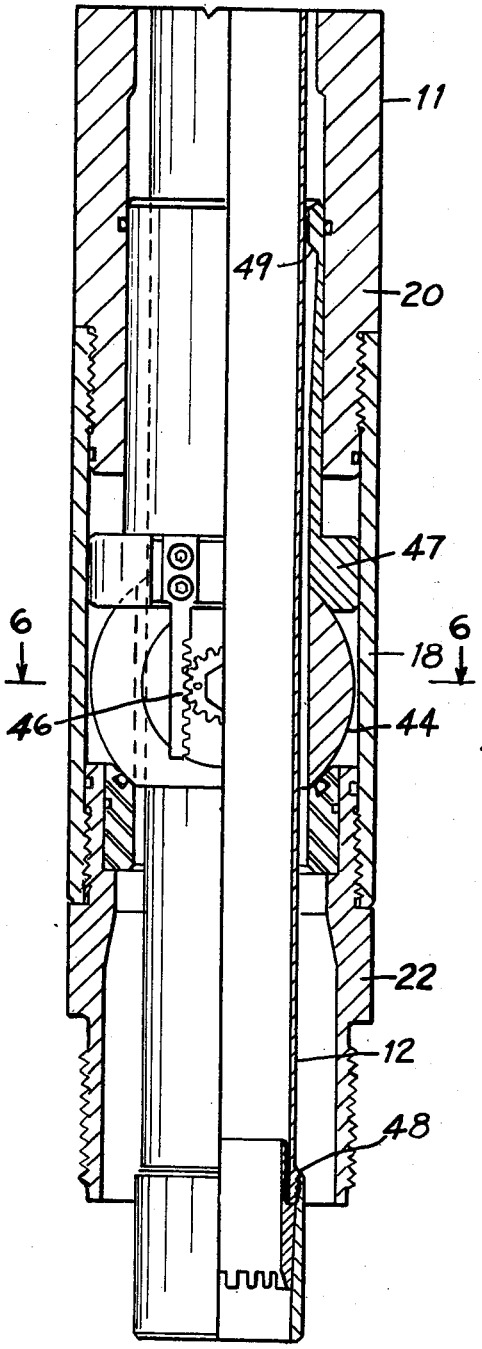
Figure 2C:
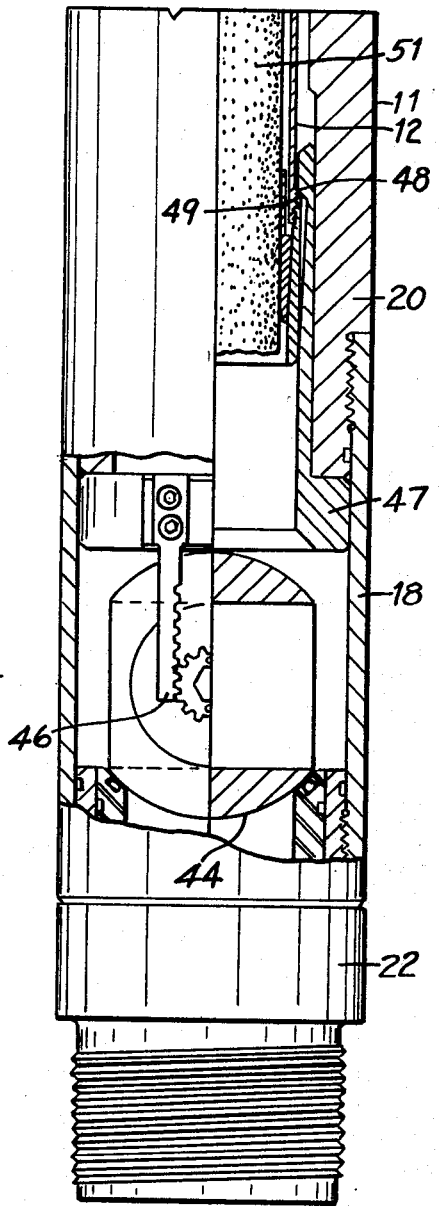

Referring now to FIGS. 1C and 2C the bottom sealing portion of the core barrel assembly is shown in detail. This includes a rotary ball valve of the same type as shown in the Blackwell et al patent, this valve being indicated at 44 as having a standard rack and pinion actuating mechanism 46 which is carried by a sleeve 47, these elements all being supported by the outer core barrel assembly.

Figure 6:
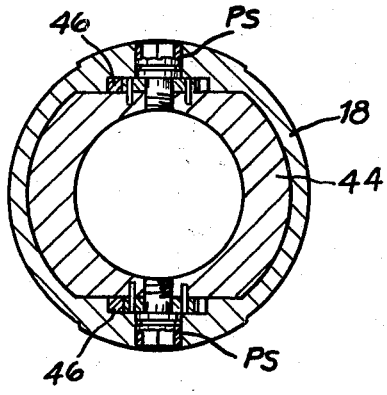
FIG. 6 is a sectional view taken through the ball valve taken along line 6—6 of FIG. 1C and FIG. 3.

As shown in FIG. 6 the rotary ball valve 44 is attched to axially aligned rotatable shoulder pivot screws PS with outer head or bearing portions journalled for rotation in aligned bearing like apertures in section 18 of the outer barrel assembly. Each of the head portions accessible from the exterior of the outer barrel section 18 has recess of polygonal shape adapted to receive a suitable allen wrench for rotating the pivot screws PS and attached rotary ball valve 44. Alternatively the heads may be slotted to receive a screw driver or other suitable tool or wrench.

Adjacent the large outer head, each pivot screw PS has a partially threaded portion extending through a pinion gear fixed with pins to each opposite side of the ball valve 44 and rotatable therewith by axial movement of the engaging rack of the rack and pinion mechanism 46.

Preferably one of the pivot screws has a right hand thread portion and the other has an opposite or left hand thread portion which prevents lossening thereof during rotation of the rack and pinion mechanism 46.

Thus, it can be seen that the pivot screws PS including the attached rotary valve 44 and pinion gear can be rotated relative to and from the exterior of the outer barrel 18 by inserting a suitable allen wrench into the recess of a pivot screw PS and turning it to either close or open the rotary valve 44.

As the outer core barrel moves downwardly past the end of the core barrel during the sealing operation on enlarged section 48 on the end of the core barrel engages shoulder 49 on the upper portion of the valve actuating cylinder 47 as the outer barrel continues to move downwardly the actuating cylinder 47 moves relative to the ball valve 44, thus actuating the rack and pinion and closing the ball valve to a position shown in FIG. 2C. In the event there is an obstruction, closing of the ball valve is prevented by compression of the spring 50 which supports the bottom of the core barrel, as seen in FIG. 2B. This spring 50 is only partially compressed in the normal operation of the valve closing motion. The core sample is shown at 51.

In connection with the arrangement of elements shown in detail above it should be noted that the upper diameter of the outer core barrel which is subjected to full mud pressure is greater than the diameter of the inner core barrel where it is sealed to the outer barrel at seal 39. Accordingly there is a greater hydraulic force pushing downwardly on the outer barrel than on the inner barrel. Thus the outer barrel will be forced downwardly, not only by the force of gravity, but by this differential hydraulic pressure. This has the advantage of assuring that the outer barrel is moved downwardly to its sealed position despite friction in the well hole or other obstructions which might tend to prevent free travel of the outer barrel down to the closed position.

Pressurizeable inlet and outlet flushing means are provided to flush drilling mud from a sealed pressure core barrel after it is brought to the surface, disconnected from the drill string and core drill bit and prior to freezing the core for analysis.

The inlet flushing means comprises, as shown in FIG. 3 an inlet end cap 56 threaded onto the end of seal sub 19 and sealing off the upper end of the core barrel assembly above and containing the upper seal mandrel 52.

The end cap 56 is connected, by inlet conduit means 58 including inlet valve means to the usual pumping means and supply of flushing fluid or medium such as gelled Varsol or kerosene which does not become frozen upon freezing of the core.

Connected to the lower opposite end of the pressure core barrel assembly are the outlet flushing means comprising an outlet flushing plug FP with a passage therein retained in the sub 22 by an outlet end cap 60 threaded onto the sub 22.

Connected to the flushing plug FP and passage therethrough are the usual outlet conduit means 62, a pressure gage g, an outlet valve means and a suitable back pressure regulator R through which the displaced drilling mud can drain out the core barrel maintained at formation pressure.

The back pressure regulator R is of the conventional type which can be set to maintain the pressure of core formation inside the core barrel while allowing the drilling mud to be flushed therefrom and out the lower outlet flushing valve even though rotary valve 44 is rotated to the open position.

In order to displace drilling mud and maintain pressure at which the core sample was sealed in the bore hole on the core sample after valve 44 is opened, the supply of flushing medium is usually pumped or forced into the core barrel at a pressure greater than the pressure on the core to which the pressure regulator R has been set to allow passage of displaced drilling mud therethrough.

The operation of the device of the present invention is like that of Blackwell et al. When the core sample 51 has been taken, the whole assembly is raised a few feet off the bottom of the drill hole in preparation for sealing the core sample. Ball 35 is then pumped down the drill string until it seats on the valve 6. At this point the pressure in the drilling mud increases compressing the spring 33 thus moving latch actuating cylinder 32 downwardly. This releases the dogs 24 which move out of the lower cylindrical groove 30 thus releasing the outer barrel 11 to travel down, both under the force of gravity and the differential hydraulic pressure. The downward motion of the outer barrel continues until the differential pressure is released by the uncovering of the vent hole 38 as the top of the outer barrel 11 passes below these vent holes. At this point the pressure drop above the ball 35 will be indicated at the well head. The mud pumping is then slowed and the spring 33 now has an upwardly exerting force on the actuating cylinder 32 thus tending to push the dogs 24 outwardly so that they are forced into the upper cylindrical groove 30 as soon as it is in the position shown in FIG. 2. The fact that the dogs have positively engaged the upper cylindrical groove 30 can be determined by lowering the assembly to the bottom of the drill hole. If these dogs are latched the outer core barrel will be retained in its locked position and the mud pressure will be continually vented through the relief holes 38. If the dogs are not latched the outer core barrel will be pushed upwardly to seal these holes 38 and the hydraulic pressure will rise again in the interior of the drill string.

As the outer core barrel moves downwardly the shoulder 43 engages the upper portion of the nitrogen cut-off valve 42 and moves its downwardly to the position shown in FIG. 2A, providing pressurization of the core barrel. At the same time the nitrogen seal 52 has moved into the restricted cylindrical portion 54 of the outer core barrel forming the upper seal for the portion of the core barrel assembly to be pressurized by the nitrogen. The portion 54 is carried by the inner cylindrical surface of the sub 19. As pointed out above the pressurization of the space below the seal formed by surfaces 52 and 54 does not take place until the outer barrel has moved essentially to the bottom of its path of travel.

In addition to opening the nitrogen cut-off, the movement of the valve 42 downwardly to the shoulder 45, positively prevents further downward motion of the outer barrel 11.

As mentioned previously the downward travel of the outer barrel has also actuated the ball valve 44 to close this valve and seal the core assembly. The core assembly is now at the predetermined pressure established for the sample. The sample is now raised to the surface in its sealed pressurized condition. At the surface all of the outer barrel structure above the sub 19 is removed as well as all of the inner core barrel assembly above the seal 52. The core barrel is then externally sealed by connecting the inlet flushing means including cap 56 to the upper end and the outlet flushing means including plug FP and cap 60 to the lower end as shown in FIG. 3. The outlet flushing means is then pressurized. With an allen wrench inserted into a pivot screw PS the rotary valve 44 is then rotated to the open position, the internal pressure determined with the pressure gage g and the regulator R set thereto. The inlet flushing means is then pressurized. Flushing is then begun by pumping gelled Varsol (Reg. TM of Exxon) or kerosene into the core barrel assembly which in turn pumps the seal 52 mandrel down until it disengages from the seal sub 19 to open the upper movable sealing means. As flushing continues, the displaced mud drains through the flushing plug FP and out the outlet valve while the suitable back pressure regulator R maintains the internal pressure inside the core barrel.

After sufficient flushing, the inlet and outlet valves are closed to maintain internal pressure and terminate flushing, the barrel packed in dry ice and the core sample and its contents frozen at internal pressure. The ball valve remains in the open position. Following freezing, the outlet valve is opened, pressure is bled off and the outlet flushing plug FP is removed. The inner tube or barrel 12 with the frozen core can then be easily removed through the open ball valve 44 for analysis in the usual manner.

In those cases where the pressure core barrel assembly is designed to contain a maximum pressure of approximately 5000 p.s.i. the present invention permits taking a core sample at a depth having a pressure substantially in excess of 5000 p.s.i. The core barrel is then raised to a depth on the order of 5000 p.s.i. and then the slip joint assembly is tripped to seal the core at said 5000 p.s.i. and the pressurized core is then raised to the surface. Where very high pressure coring is to be done and the intermediate pressure sealing is employed, a rupture disc (set for 6000 p.s.i. for example) can be used to prevent surface explosions if the core barrel has been inadvertently sealed under abnormally high ambient pressure.

What is claimed is:

1. A flushing system for flushing drilling mud from a pressure core barrel assembly adapted for containing and maintaining a core sample taken from a bore hole sealed therein under a controlled pressure substantially equal to the pressure present at a depth in the bore hole at which the core sample is sealed off to freezing of the core sample for analysis comprising:

pressurizing inlet flushing means connected to an end portion of the pressure core barrel assembly containing movable sealing means and adapted for pressurizing and conveying a flushing medium under sufficient pressure into the pressure core barrel assembly to disengage and open the movable sealing means, flush out and displace drilling mud from the pressure core barrel assembly; and pressurizable outlet flushing means connected to an opposite end portion of the pressure core barrel assembly containing valve sealing means operable to an open or closed position from the exterior of the pressure core barrel assembly and adapted for pressurizing, determining internal pressure, conveying and maintaining drilling mud displaced from the pressure core barrel assembly by the flushing medium substantially to at least the internal pressure therein at which the core sample was sealed in the bore hole;

whereby the sealing means in the pressure core barrel assembly will be opened for a more complete flushing of the drilling mud therefrom without loss of internal pressure and contents from the core sample, the core sample maintained and frozen at substantially the pressure it was sealed at in the bore hole and with the sealing means in the open position, the outlet flushing means disconnected and the frozen core sample extracted for analysis.

2. A flushing system according to claim 1 wherein the pressurizeable inlet flushing means comprises:

an inlet flushing end cap with a passage therein connected to one end of the core barrel assembly, inlet conduit means connected to the inlet flushing end cap for conveying flushing medium to the pressure core barrel assembly, flushing medium supply means connected to the inlet conduit means for conveying the flushing medium under pressure to the core barrel, and inlet valve means in the inlet conduit means for closing or opening the inlet conduit means.

3. A flushing system according to claim 2 wherein the pressurizeable outlet flushing means comprises:

an outlet flushing plug with a passage therein connected to the opposite end portion of the pressure core barrel assembly, outlet conduit means connected to the outlet flushing plug for conveying displaced drilling mud from the pressure core barrel assembly, pressure gaging means connected to the outlet conduit means for determining the internal pressure on the core sample within the pressure core barrel, outlet valve means in the conduit means for closing or opening the outlet conduit means, and pressure regulating means connected to the outlet conduit means for maintaining a back pressure on the displaced drilling mud and the core sample within the pressure core barrel assembly substantially to at least the internal pressure therein at which the core sample was sealed in the bore hole.

4. A flushing system according to claim 3 wherein the pressure core barrel assembly further comprises:

an outer barrel assembly including a seal sub at one end thereof having an internal seal engaging surface portion, and an end portion connected to the inlet flushing end cap, an inner barrel assembly slideably mounted within and axially movable relative to the outer barrel assembly and having a seal mandrel with sealing means thereon engageable with the internal seal engaging surface portion of the seal sub for sealing off one end of a pressure chamber between the inner and outer barrel.

5. A flushing system according to claim 4 wherein the valve sealing means comprises:

a rotary valve journalled for rotation into engagement with cooperating seal means in a portion of the outer barrel assembly situated between the opposite end portion connected to the outlet flushing means and an opposite end of the pressure chamber.

6. A flushing system according to claim 5 wherein inner barrel assembly further comprises:

a core tube for receiving and retaining the core sample therein, pneumatic control means connected to and axially movable with the core tube and the seal mandrel for maintaining the controlled pressure in the sealed pressure chamber and on the core sample therein.

7. A flushing system according to claim 6 wherein the rotary valve sealing means is operated to close and seal off the opposite end portion of the outer barrel assembly, the pressure chamber and core sample therein by actuating means responsive to the axial movement of the outer barrel assembly.

8. A flushing system according to claim 7 wherein the rotary valve sealing means further comprises:

bearing means fixed to and extending from the rotary valve sealing means into bearing receiving apertures in the outer barrel assembly, and tool engageable means at an end of the bearing means accessible from the exterior of the outer barrel assembly for rotating the rotary valve sealing means to an open or closed position.

9. A method of using the flushing system and flushing drilling mud from the pressure core barrel assembly as defined in claim 1 which is adapted to and contains and maintains a core sample taken from a bore hole sealed therein under a controlled pressure substantially equal to the pressure present at a depth in the bore hole at which the core sample was sealed off to freezing of the core sample for analysis comprising the steps of:

connecting the pressurizeable inlet flushing means to the end portion of the pressure core barrel containing the movable sealing means, connecting the pressurizeable outlet flushing means to the opposite end portion of the pressure core barrel containing the valve sealing means operable from the exterior of the core barrel assembly, pressurizing the outlet flushing means, actuating and opening the valve sealing means from the exterior of the pressure core barrel assembly, determining and maintaining the internal pressure on the core sample in the pressure core barrel assembly, pressurizing the inlet flushing means, conveying the flushing medium through the inlet flushing means and into the pressure core barrel assembly as sufficient pressure to disengage and open the movable sealing means, flush out and displace drilling mud therefrom and out the outlet flushing means while maintaining a sufficient amount of back pressure on the displaced mud to maintain the internal pressure on the core sample in the pressure core barrel assembly, closing off the inlet and outlet flushing means to stop flow of the flushing medium and maintain the internal pressure in the pressure core barrel, freezing the core sample in the pressure core barrel while maintaining the internal pressure thereon to preserve the contents of the core sample, opening the outlet flushing means to bleed off the internal pressure, disconnecting the outlet flushing means from the pressure core barrel, and removing the frozen core sample from the pressure core barrel for analysis.

10. A method of using the flushing system according to claim 9 wherein the step of actuating and opening the valve sealing means from the exterior of the core barrel comprises:

rotating the valve seal means with a tool adapted to engage and turn a bearing portion of the valve seal means journalled in and accessible from the exterior of the pressure core barrel assembly.

11. A method of using the flushing system according to claim 10 wherein the step of conveying the flushing medium to displace the drilling mud further comprises:

flushing and displacing the drilling mud with a flushing medium which does not freeze at the temperature at which the core sample is frozen.

* * * * *

UNITED STATES PATENT AND TRADEMARK OFFICE

CERTIFICATE OF CORRECTION

PATENT NO. : 4,272,987

DATED : June 16, 1981

INVENTOR(S) : James T. Aumann and Harold G. White

It is certified that error appears in the above-identified patent and that said Letters Patent are hereby corrected as shown below:

Column 7, line 41, "pressurizing" should read -- pressurizeable --.

Signed and Sealed this

Second Day of February 1982

[SEAL]

Attest:

GERALD J. MOSSINGHOFF

Attesting Officer

Commissioner of Patents and Trademarks